US011739527B2

(12) United States Patent
Lloyd

(10) Patent No.: US 11,739,527 B2
(45) Date of Patent: Aug. 29, 2023

(54) STRUCTURAL BEAM

(71) Applicant: NETTING SERVICES (NORTHERN) LTD, Cleveland (GB)

(72) Inventor: Kevin Anthony Lloyd, Cleveland (GB)

(73) Assignee: NETTING SERVICES (NORTHERN) LTD

( * ) Notice: Subject to any disclaimer, the term of this patent is extended or adjusted under 35 U.S.C. 154(b) by 0 days.

(21) Appl. No.: 16/756,601

(22) PCT Filed: Oct. 15, 2018

(86) PCT No.: PCT/GB2018/052959
§ 371 (c)(1),
(2) Date: Apr. 16, 2020

(87) PCT Pub. No.: WO2019/077324
PCT Pub. Date: Apr. 25, 2019

(65) Prior Publication Data

US 2020/0256055 A1 Aug. 13, 2020

(30) Foreign Application Priority Data

Oct. 18, 2017 (GB) ..... 1717087

(51) Int. Cl.
*E04C 3/29* (2006.01)
*E04B 5/02* (2006.01)
(Continued)

(52) U.S. Cl.
CPC ..... *E04C 3/29* (2013.01); *E04B 5/026* (2013.01); *E04C 3/28* (2013.01);
(Continued)

(58) Field of Classification Search
CPC ..... E04C 3/29; E04C 2003/0413; E04C 2003/0434; E04C 2003/0452;
(Continued)

(56) References Cited

U.S. PATENT DOCUMENTS 2,263,272 A * 11/1941 Moss ..... E04C 3/06 52/840
2,284,898 A * 6/1942 Hartman ..... E04C 3/04 52/696

(Continued)

FOREIGN PATENT DOCUMENTS

CA 2639339 A1 3/2010
EP 3075924 A 10/2016

(Continued)

OTHER PUBLICATIONS

PCT/GB2018/052959, International Search Report and Written Opinion, Feb. 13, 2019, 9 pages.

*Primary Examiner* — Brian E Glessner
*Assistant Examiner* — Adam G Barlow
(74) *Attorney, Agent, or Firm* — Stoel Rives LLP

(57) ABSTRACT

The invention relates to a structural beam for use in a building, the structural beam comprising a first end, a second end and a longitudinal axis extending therebetween; at least two spaced apart wall members each wall member extending parallel with the longitudinal axis, abase member spanning between the at least two spaced apart wall members, wherein the base member and each wall member cooperate to form a trough for receiving cement, wherein each wall member includes: a first ledge extending outwardly away from the trough and; a second ledge extending outwardly away from the trough; wherein the first ledge and second ledge cooperate to form a channel dimensioned for receiving a part of an insulation member.

8 Claims, 4 Drawing Sheets

(51) Int. Cl.
*E04C 3/28* (2006.01)
*E04C 3/04* (2006.01)

(52) U.S. Cl.
CPC ..... *E04C 2003/0413* (2013.01); *E04C 2003/0434* (2013.01); *E04C 2003/0452* (2013.01); *E04C 2003/0473* (2013.01)

(58) Field of Classification Search
CPC .... E04C 2003/0473; E04C 3/28; E04B 5/026; E04B 1/7654; E04B 2001/2481; E04B 5/16; E04B 5/00; E04F 15/18
USPC ..... 52/282.1, 282.2, 262, 319
See application file for complete search history.

(56) References Cited

U.S. PATENT DOCUMENTS 3,300,839 A * 1/1967 Lichti ..... B21D 47/04 52/840
3,983,668 A 10/1976 Hassman
4,350,459 A * 9/1982 Bryant ..... B62D 33/044 403/263
4,424,652 A * 1/1984 Turner ..... E04C 3/02 52/204.2
4,745,718 A * 5/1988 O'Sullivan ..... E04C 3/14 52/847
5,081,806 A * 1/1992 Pommelet ..... E02D 27/34 52/167.5
6,826,884 B2 * 12/2004 Pabedinskas ..... E04C 3/29 52/839
D814,660 S * 4/2018 Chapman ..... D25/60
D815,302 S * 4/2018 Chapman ..... D25/60
D851,287 S * 6/2019 Singh ..... E04F 19/062 D25/119
2003/0030241 A1 * 2/2003 Lawson ..... B60G 7/001 280/124.142
2003/0089050 A1 * 5/2003 Tipping ..... E04G 25/06 52/127.2
2004/0219357 A1 * 11/2004 Van Dijk ..... B29C 48/90 264/108
2004/0250489 A1 * 12/2004 Rojas ..... E04C 3/07 52/474
2006/0101781 A1 * 5/2006 Watts ..... G01B 21/30 52/749.1
2007/0256382 A1 11/2007 Drolet
2008/0099131 A1 * 5/2008 Umeda ..... B29C 66/919 156/201
2013/0283728 A1 * 10/2013 Chang ..... E04C 3/02 52/846
2013/0312346 A1 * 11/2013 To ..... E04C 3/28 52/837
2014/0099456 A1 * 4/2014 Raghavendran .... E04G 23/0218 428/167
2015/0013252 A1 * 1/2015 Sharif ..... E04C 3/29 52/223.8
2015/0336621 A1 * 11/2015 Godon ..... E04C 3/29 156/245
2016/0280163 A1 * 9/2016 Matecki ..... B60R 19/023
2016/0311470 A1 * 10/2016 Smith ..... B62D 53/068
2016/0369508 A1 * 12/2016 Davis ..... E04C 3/06
2017/0275870 A1 * 9/2017 Ohm ..... E04B 1/944
2018/0356180 A1 * 12/2018 Heninger ..... F41A 23/18

FOREIGN PATENT DOCUMENTS

FR 701796 A 3/1931
GB 1062806 A 3/1967
GB 1401267 A 7/1975
GB 1538063 A 1/1979
KR 1020030008875 A 1/2003
WO 9606242 A1 2/1996

* cited by examiner

STRUCTURAL BEAM

RELATED APPLICATIONS

This application is a national phase application of International Patent Application No. PCT/GB2018/052959, filed Oct. 15, 2018, which claims the benefit of Great Britain Application No. 1717087.9 filed Oct. 18, 2017, both of which are hereby incorporated by reference herein in their entirety.

FIELD OF THE INVENTION

The present invention relates broadly to building construction and particularly to floor beams, systems comprising the floor beams and method of constructing a floor using the floor beams.

BACKGROUND TO THE INVENTION

Traditional beam and block floor systems, which remains the principal flooring system of choice within a domestic setting in the UK includes concrete T beams and blocks interspersed between the T beams. Insulation is placed above the finished structural floor and a concrete screed laid above the insulation.

The concrete floor beams weigh typically around 30 to 40 KG per metre. They therefore require installation by mechanical lifting equipment (e.g., an excavator or crane). The blocks laid between the floor beams are normally concrete blocks generally 440 mm×215 mm×100 mm, and are laid flat by hand.

Advantages of the traditional beam and block system include cost, availability of product around the UK, and the creation of an instant working floor on which finishes can be later applied. Furthermore, most builders are familiar with the design of the system.

The practical disadvantages of the beam and block system include that the beams and blocks are heavy and create a significant manual handling risk. Accordingly, they require a substantial amount of labour to lay the floor. An additional disadvantage includes the cost of the mechanical lifting equipment (including the provision of a designed safe working base for the crane to stand).

The technical disadvantages of the beam and block system include that the thermal insulation value of the floor (i.e., the U value) is provided solely by the insulation layer. In order to achieve the UK's building regulations, an insulation thickness of 150 mm is common. This adds 150 mm to the overall build height of the house. In addition, the Concrete screed is a dead weight which must be carried on the floor beams below as it does not form a structural use.

To overcome the issue of increasing thickness of insulation, an alternative system implemented within some of the more recent flooring uses the traditional concrete T beams but replaces the concrete infill block with polystyrene (e.g., expanded polystyrene "EPS") blocks. The polystyrene wraps under the floor beam to insulate this 'cold' product and provides the insulation required without the addition of an insulation sheet above the floor beam. The concrete screed is then applied directly on top of the polystyrene.

An advantage of this hybrid system is that the overall thickness of the floor is reduced, whilst still providing the required U values. However, the disadvantages include that the concrete T beams are still too heavy to lift manually, the depth of insulation under the floor beams requires additional site excavation, and the screed again acts as a dead weight on the floor beams and does not contribute to the strength of the floor. The floor beams are thermally 'cold' and require fully insulation to avoid heat loss. The different components required mean that the floor is difficult to install and there is a lot of waste.

There is therefore a need for a flooring system which has improved manual handling characteristics and improved mechanical properties such as insulation and long-term strength.

SUMMARY OF THE INVENTION

According to a first aspect of the invention there is provided a structural beam for use in a building, the structural beam comprising;

- a first end, a second end and a longitudinal axis extending therebetween;
- at least two spaced apart wall members each wall member extending parallel with the longitudinal axis,
- a base member spanning between the at least two spaced apart wall members, wherein the base member and each wall member cooperate to form a trough for receiving cement, wherein each wall member includes:

- a first ledge extending outwardly away from the trough and;
- a second ledge extending outwardly away from the trough; wherein the first ledge and second ledge cooperate to form a channel dimensioned for receiving a part of an insulation member, wherein the structural beam includes a camber between the first end and the second end to compensate for the weight of the concrete when the beam is in situ.

The provision of a camber between the first end and the second end is designed so that the deflection of the beam caused by the loading of structural concrete onto the top of the beam is within building tolerances.

Optionally, the structural beam is a floor beam. In some constructions, the floor beam may have a depth of about 150 mm or about 225 mm in order to coordinate with standard build heights of floor beams within the UK. Accordingly, a conventional concrete T beam can be readily replaced with a floor beam of the present invention.

The provision of selection of floor beams having varying depths enables a beam having a greater depth to be used in order to cater for longer beam spans and/or heavier loads.

A floor system may comprise a plurality of beams each having a depth of 150 mm with the beams being spaced apart by about 400 mm. An insulation member, such as a polystyrene block, is provided between adjacent beams. Each beam has a predefined, set strength. Accordingly, when the span of the beam lengthens and/or the loading on the beam increases, the beam centres will need to be moved closer together. This provides more beams per metre width, enabling the beams to retain the load without structural failure. As a result of the narrowing of the space between adjacent beams, narrower polystyrene blocks will be required.

However, a point will be reached at which the 150 mm deep beams cannot be moved any closer together. At this point the 150 mm deep beams may be substituted with, beams having a greater depth. For example, 225 mm deep beams.

The provision of a trough within the beam enables concrete screed to be poured into the beam. Once the concrete has set the beam and the screed act as a composite structural element. The concrete will also be poured over the upper surface of the beam, and the upper surface of the insulation member.

Optionally, the structural beam is made of a polymer, for example a fibre reinforced polymer (FRP). FRP includes the class of materials known as Glass Reinforced Polymer (GRP) or Carbon Fibre Polymers.

FRP components may be manufactured by was of a pultrusion process. Pultrusion is a mechanical process that draws continuous fibres impregnated with a thermosetting resin through a heated die that polymerises the resin and forms the composite shape of the pultruded profile in a continuous process.

Despite being of a lighter weight material, pultruded FRP is similar in strength to steel and concrete in tension and compression but not as stiff.

A polymer floor beam, such as a pultruded beam is much lighter than equivalent concrete beams and is therefore easier to manually handle. This improves the health and safety issues surrounding the handling of such beams. Furthermore, as the beam of the invention can be moved around a construction/building site manually and also installed by hand, there is a reduction in the associated cost of mechanical equipment (e.g., cranes), as well as the labour costs required to install a floor.

It is envisaged that the load applied by the concrete screed upon the top surface of the beam may cause the beam to deflect. This will lead, at least temporarily, to an uneven floor. This effect might be counteracted by incorporating a camber along the length of the beam. As the concrete is applied the beam will end up level. The amount of camber provided in a given beam may be chosen in accordance with the application that is envisaged. The factors used to determine the camber may, for instance, include the strength of the beam, the length of the beam and the amount (weight) of the concrete that is to be used.

Optionally therefore, a structural beam according to the invention includes a camber provided between the first end and the second end to compensate for the weight of the concrete when the beam is in situ.

Once the concrete screed has set, with the structural beam roughly levelled out underneath, the concrete will be bonded to the beam and form a composite structural floor. The screed will not simply be carried by the beam, as in the case of a traditional concrete T beam. Instead, the floor will work compositely using the compressive strength of the concrete on top of the beam and the tensile strength at the bottom of the beam, thus creating a strong floor which is capable of carrying the uniformly distributed superimposed floor load applied in the finished structure.

In some constructions of the structural beam, the first ledge extends outwardly from a first end of the wall member and the second ledge extends outwardly from a second end of the wall member.

In some constructions of the structural beam, one or both of the first ledge and the second ledge extend outwardly from the wall member at an angle substantially perpendicular to the wall member.

In constructions of the structural beam in which the first ledge extends outwardly from a first end of the wall member and the second ledge extends outwardly from a second end of the wall member, it is advantageous that the ledges extend at an angle substantially perpendicular to the wall member as it ensures that the floor beam is able rest evenly on the foundations and also that the concrete screed is applied as a flat, even surface above the beam.

The retention of at least part of the insulation member prevents the insulation member from protruding underneath the beam. This is advantageous as it prevents the need for additional site excavation to compensate for the depth of the insulation.

According to a second aspect of the invention, there is provided a system for use in a building, the system comprising:

a structural beam as herein described; and an insulation member, at least part of which is retained within the channel formed by the cooperation of the first ledge and second ledge of at least the first wall member.

Optionally, an insulation member is retained within the channel formed by the cooperation of the first and second ledge of the first wall member and the second wall member. As such, the unit provided has a centrally located beam with an insulation member retained on either side.

Optionally, an insulation member is retained within the channel formed by the cooperation of the first and second ledge on a first wall member and the retaining member is also retained within the channel formed by the cooperation of the first and second ledge on a second wall member. As such, the unit provided includes a centrally located insulation member with a beam on each side.

At least part of the insulation member, for example an edge, is bonded to at least part of the channel.

Optionally, the insulation member is a polystyrene, for example an expanded polystyrene (EPS). The U value of the flooring system may be lowered by, for example, choosing a thermally enhanced polystyrene.

The U value of the flooring system may be lowered by increasing the depth of the insulation member.

According to a third aspect of the invention, there is provided a floor constructed using a plurality of structural beams as herein described.

According to a fourth aspect of the invention, there is provided a kit comprising:

a structural beam as herein described, and an insulation member.

According to a fifth aspect of the invention there is provided a method of installing a floor system within a building, the method comprising the steps of:

(a) installing a structural beam as described herein;

(b) installing at least part of an insulation member into the channel formed by the cooperation of the first ledge and the second ledge of at least the first wall member or the second wall member.

After step (b), the method may further comprise the step of installing a second structural beam adjacent to the first beam and installing at least part of the insulation member into the channel formed by the cooperation of the first ledge and the second ledge of at least the first wall member or the second wall member of the second structural beam.

After step (b), the method may further comprise the step of installing at least a part of a second insulation member into the channel formed by the cooperation of the first ledge and the second ledge of at least the first wall member or the second wall member of the structural beam.

The method of installing a floor system within a building may also comprise a step of pouring concrete into the trough formed by the cooperation of the base member and each wall member.

BRIEF DESCRIPTION OF THE DRAWINGS

The invention will now be described by way of example with reference to the accompanying drawings in which.

DETAILED DESCRIPTION OF THE DRAWINGS

Although particular constructions of the invention have been described, it will be appreciated that many modifications/additions and/or substitutions may be made within the scope of the claimed invention.

Figure 1:
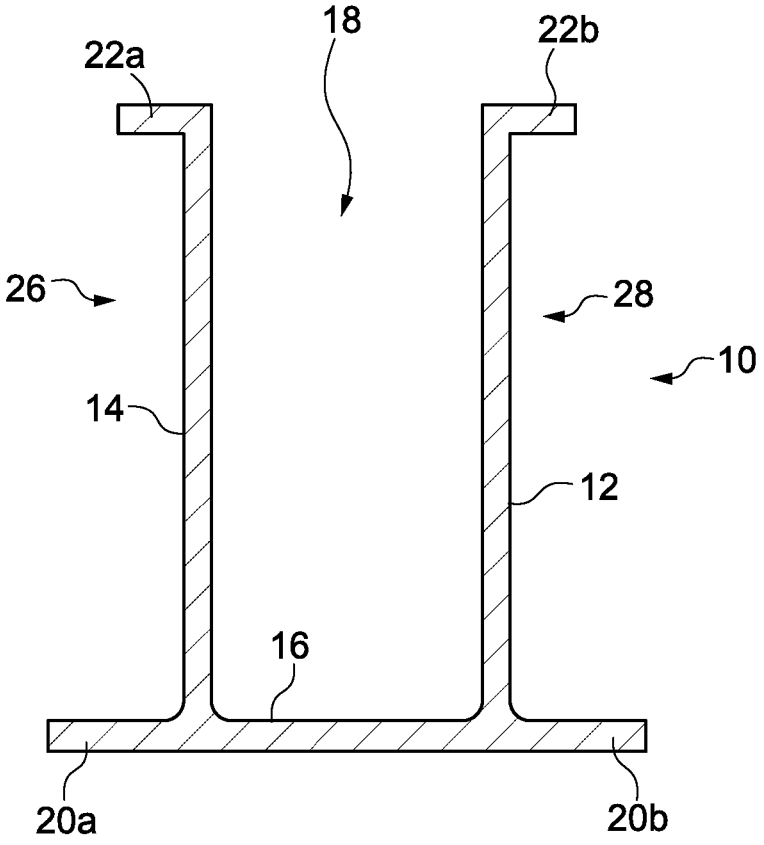
FIG. 1 shows a schematic of a cross section of a structural beam according to the present invention.

FIG. 1 shows an example of the structural beam 10 of the present invention. This structural beam is shown as a floor beam. The floor beam 10 includes a first wall member 12 which is spaced apart from the second wall member 14. Each wall member extends parallel with a longitudinal axis that extends along the length of the beam from a first end to a second end. A base member 16 spans between the first wall member and the second wall member. The base member 16 cooperates with the first wall member 12 and the second wall member 14 to form a trough 18 for receiving cement.

The first wall member 12 includes a first ledge 20*a* extending outwardly away from the trough 18. As shown in this construction, the first ledge 20*a* extends outwardly from the wall member at an angle that is substantially perpendicular to the wall member. The first ledge extends outwardly in line with the base member 16.

The first wall member 12 also includes a second ledge 22*a* extending outwardly away from the trough 18. As shown in this construction, the second ledge 22*a* extends outwardly from the wall member at an angle that is substantially perpendicular to the wall member. The second ledge extends outwardly from the top end 24 of the beam.

The first ledge 20*a* and the second ledge 22*a* on the first wall member 12 cooperate to form a channel 26 for receiving a part of an insulation member.

The second wall member 14 includes a first ledge 20*b* extending outwardly away from the trough 18. As shown in this construction, the first ledge 20*b* extends outwardly from the wall member at an angle that is substantially perpendicular to the wall member. The first ledge extends outwardly in line with the base member 16.

The second wall member 14 also includes a second ledge 22*b* extending outwardly away from the trough 18. As shown in this construction, the second ledge 22*b* extends outwardly from the wall member at an angle that is substantially perpendicular to the wall member. The second ledge extends outwardly from the top end 24 of the beam.

The first ledge 20*b* and the second ledge 22*b* on the second wall member 14 cooperate to form a channel 28 for receiving a part of an insulation member.

Figure 2:
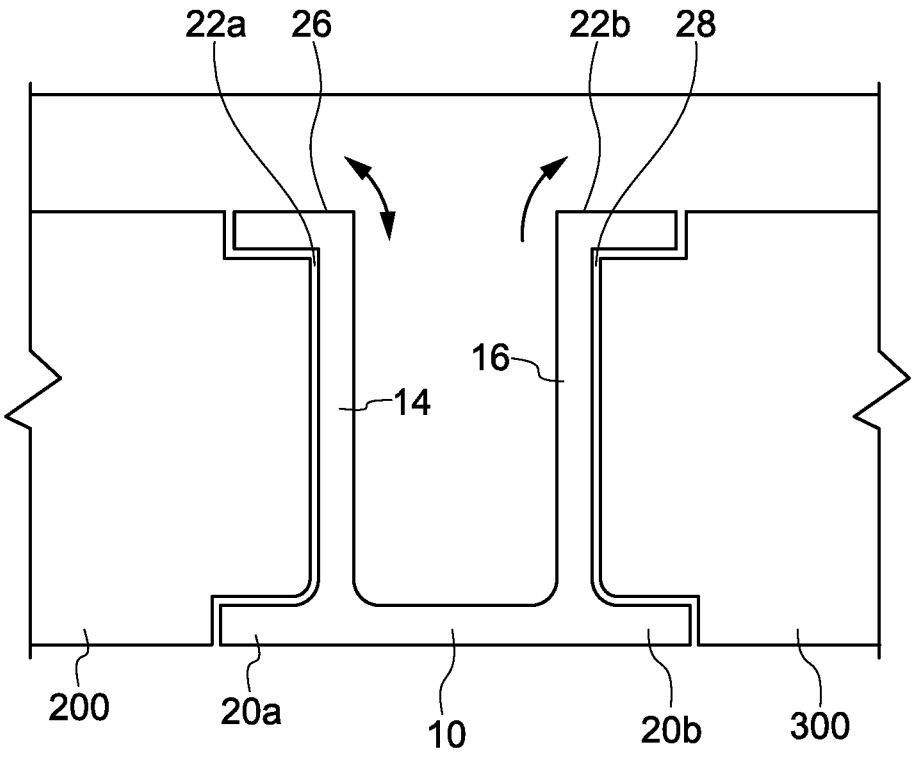
FIG. 2 shows a floor system using the structural beam according to the present invention.

FIG. 2 shows a floor system 100 constructed using the structural beam 10 according to the present invention. A region of a first insulation member 200 is received and retained within channel 26 of the beam. A region of a second insulation member 300 is received and retained within channel 28 of the beam. A concrete screed 400 is poured into the trough 18 and over the upper surface of the beam 10, the first insulation member 200 and the second insulation member 300.

The structural beam of the invention may be delivered to the construction site as a standalone unit. Optionally, the structural beam may be delivered as a preassembled unit with an insulation member 200.

Figure 3:
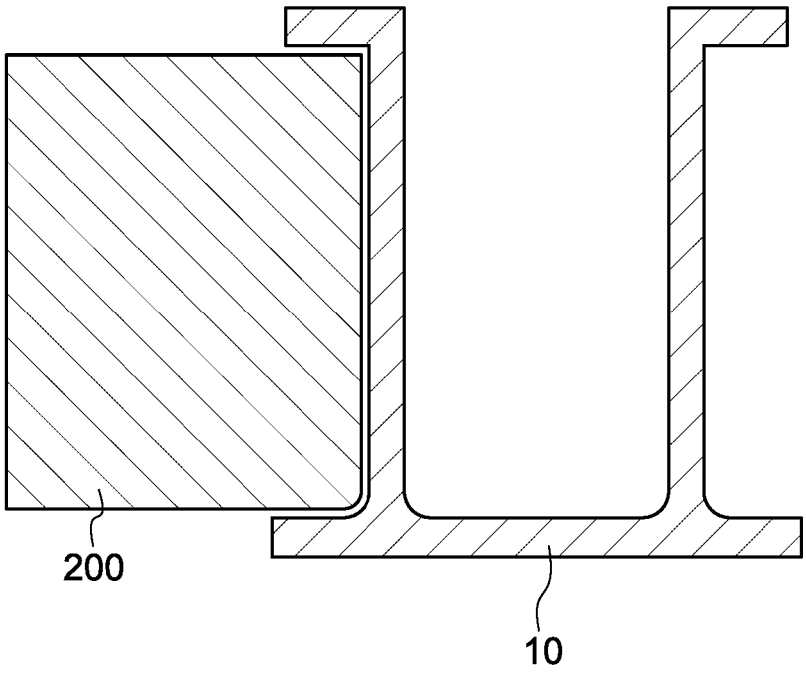
FIG. 3 shows a first unit consisting of a structural beam according to the present invention preassembled with an insulation member.

FIG. 3 shows a unit that consists of a structural beam 10 of the present invention preassembled with an insulation member 200. In this construction the insulation member is retained within the channel associated with the first wall member. It is also envisaged that in the alternative, the insulation member is retained within the channel associated with the second wall member.

Figure 4:
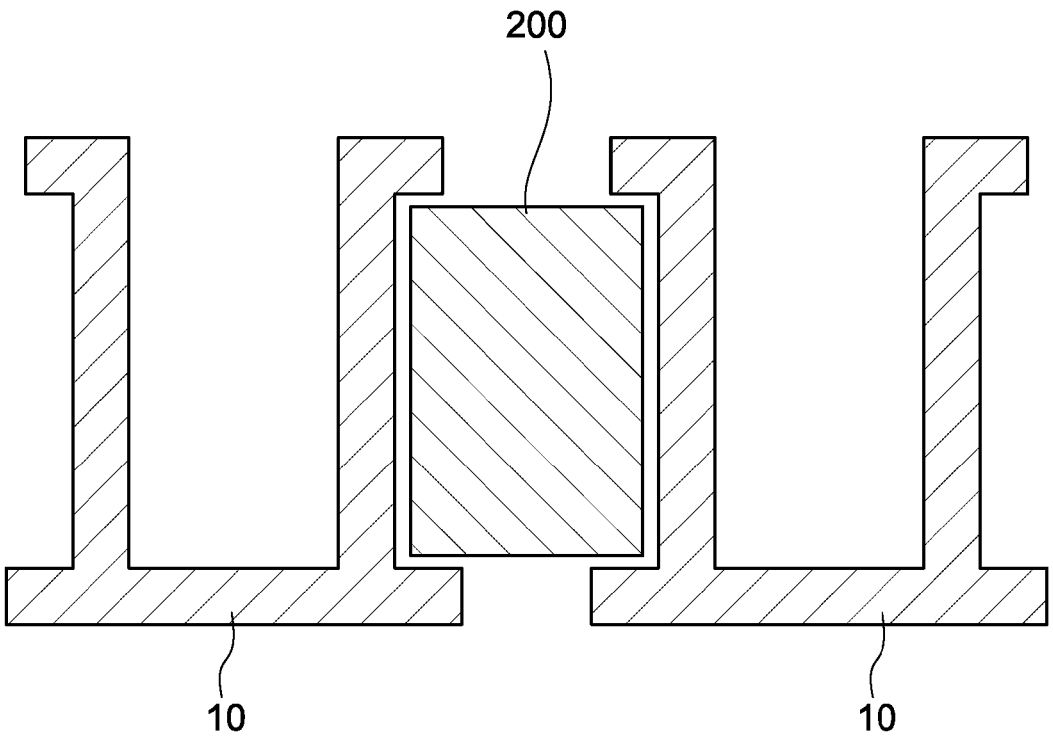
FIG. 4 shows a second unit consisting of an assembly of two structural beams according to the present invention which are preassembled with an insulation member sandwiched therebetween.

FIG. 4 shows a unit that consists of two structural beams 10 of the present invention preassembled with an insulation member 200 sandwiched inbetween.

Although particular constructions of the invention have been described, it will be appreciated that many modifications/additions and/or substitutions may be made within the scope of the claimed invention.

The invention claimed is:

1. A system for use in a building, the system comprising:

a structural beam for use in the building, the structural beam comprising a first end, a second end and a longitudinal axis extending there-between;

at least two spaced apart wall members, each wall member extending parallel with the longitudinal axis; and a base member spanning between the at least two spaced apart wall members, wherein the base member and each wall member cooperate to form a trough for receiving concrete, wherein each wall member includes:

a first ledge extending outwardly away from the trough; and a second ledge extending outwardly away from the trough, wherein the first ledge and the second ledge cooperate to form a channel dimensioned for receiving a part of an insulation member, wherein the first ledge is in the same plane as the base member, wherein the structural beam comprises a fiber reinforced polymer having continuous fibers extending longitudinally between the first end and second end, and includes a camber between the first end and the second end to compensate for the weight of the concrete within the trough when the beam is in situ, and wherein the structural beam is a floor beam; and the insulation member, at least part of which is retained within the channel formed by the cooperation of the first and second ledge of at least the first wall member.

2. The system according to claim 1, in which a first insulation member is retained within the channel formed by the cooperation of the first and second ledge of the first wall member and a second insulation member is retained within the channel formed by the cooperation of the first and second ledge of the second wall member.

3. The system according to claim 1, in which the insulation member is bonded to at least part of the channel.

4. The system according to claim 1, in which the insulation member is a polystyrene.

5. The system according to claim 4, in which the polystyrene is an expanded polystyrene (EPS).

6. A floor constructed using a plurality of structural beams, wherein each structural beam comprises:

a first end, a second end and a longitudinal axis extending there-between;

at least two spaced apart wall members, each wall member extending parallel with the longitudinal axis; and a base member spanning between the at least two spaced apart wall members, wherein the base member and each wall member cooperate to form a trough for receiving concrete, wherein each wall member includes:

a first ledge extending outwardly away from the trough; and a second ledge extending outwardly away from the trough, wherein the first ledge and the second ledge cooperate to form a channel dimensioned for receiving a part of an insulation member, wherein the first ledge is in the same plane as the base member, wherein each structural beam comprises a fiber reinforced polymer having continuous fibers extending longitudinally between the first end and second end, and includes a camber between the first end and the second end to compensate for the weight of the concrete within the trough when the beam is in situ, and wherein each structural beam is a floor beam.

7. A kit comprising:

a structural beam for use in a building, the structural beam comprising a first end, a second end and a longitudinal axis extending there-between;

at least two spaced apart wall members, each wall member extending parallel with the longitudinal axis; and a base member spanning between the at least two spaced apart wall members, wherein the base member and each wall member cooperate to form a trough for receiving concrete, wherein each wall member includes:

a first ledge extending outwardly away from the trough; and a second ledge extending outwardly away from the trough, wherein the first ledge and the second ledge cooperate to form a channel dimensioned for receiving a part of an insulation member, wherein the first ledge is in the same plane as the base member, wherein the structural beam comprises a fiber reinforced polymer having continuous fibers extending longitudinally between the first end and second end, and includes a camber between the first end and the second end to compensate for the weight of the concrete within the trough when the beam is in situ, and wherein the structural beam is a floor beam; and the insulation member.

8. A method of installing a floor system within a building, the method comprising the steps of:

(a) installing a structural beam for use in the building, the structural beam comprising a first end, a second end and a longitudinal axis extending there-between;

at least two spaced apart wall members, each wall member extending parallel with the longitudinal axis; and a base member spanning between the at least two spaced apart wall members, wherein the base member and each wall member cooperate to form a trough for receiving concrete, wherein each wall member includes:

a first ledge extending outwardly away from the trough; and a second ledge extending outwardly away from the trough, wherein the first ledge and the second ledge cooperate to form a channel dimensioned for receiving a part of an insulation member, wherein the first ledge is in the same plane as the base member, wherein the structural beam comprises a fiber reinforced polymer having continuous fibers extending longitudinally between the first end and second end, and includes a camber between the first end and the second end to compensate for the weight of the concrete within the trough when the beam is in situ, and wherein the structural beam is a floor beam; and (b) installing the at least part of the insulation member into the channel formed by the cooperation of the first ledge and the second ledge of at least the first wall member or the second wall member.

* * * * *